US010722924B2

(12) United States Patent
Tu et al.

(10) Patent No.: US 10,722,924 B2
(45) Date of Patent: Jul. 28, 2020

(54) DUST REMOVAL DEVICE FOR A DISPLAY SCREEN, DUST REMOVAL METHOD AND CORRESPONDING DISPLAY DEVICE

(71) Applicants: BOE TECHNOLOGY GROUP CO. LTD., Beijing (CN); K-TRONICS (SU ZHOU) TECHNOLOGY CO., LTD., Shuzhou, Jiangsu (CN)

(72) Inventors: Chuang Tu, Beijing (CN); Shuanshuan Kong, Beijing (CN)

(73) Assignees: BOE TECHNOLOGY GROUP CO., LTD., Beijing (CN); K-TRONICS (SU ZHOU) TECHNOLOGY CO., LTD., Suzhou, Jiangsu (CN)

( * ) Notice: Subject to any disclaimer, the term of this patent is extended or adjusted under 35 U.S.C. 154(b) by 0 days.

(21) Appl. No.: 15/566,646

(22) PCT Filed: Apr. 27, 2017

(86) PCT No.: PCT/CN2017/082215
§ 371 (c)(1),
(2) Date: Oct. 13, 2017

(87) PCT Pub. No.: WO2017/202173
PCT Pub. Date: Nov. 30, 2017

(65) Prior Publication Data

US 2019/0070641 A1 Mar. 7, 2019

(30) Foreign Application Priority Data

May 27, 2016 (CN) ..... 2016 1 0373425

(51) Int. Cl.
*B08B 5/02* (2006.01)

(52) U.S. Cl.
CPC ..... *B08B 5/02* (2013.01)

(58) Field of Classification Search
CPC ..... B08B 5/02; B08B 5/00; B08B 13/00
See application file for complete search history.

(56) References Cited

U.S. PATENT DOCUMENTS 5,361,449 A * 11/1994 Akimoto ..... B08B 1/04 15/302
8,037,890 B2 * 10/2011 Yamamoto ..... H01L 21/67051 134/103.2

(Continued)

FOREIGN PATENT DOCUMENTS

CN 102024670 A 4/2011
CN 201978923 U 9/2011

(Continued)

OTHER PUBLICATIONS

State Intellectual Property Office of People's Republic of China, "Second Office Action," issued in connection with Chinese Patent Application No. 201610373425.6, dated May 8, 2018, 17 pages.

(Continued)

*Primary Examiner* — Dung Van Nguyen
(74) *Attorney, Agent, or Firm* — Arent Fox LLP; Michael Fainberg

(57) ABSTRACT

The exemplary embodiments of the present disclosure relate to the field of clean technologies, and particularly to a dust removal device for a display screen, a dust removal method and corresponding display device. The dust removal device comprises at least one nozzle which is configured to eject gas to the display screen; at least one mobile device which is configured to move the at least one nozzle to a predetermined position; a gas supply device which is connected with the at least one nozzle via a conduit; and a control device which is configured to control the movement of the at least one mobile device and the gas ejection of the at least one nozzle. The dust removal device and the corresponding display device based on the exemplary embodiments of the (Continued)

present disclosure can realize fixed-point mechanical dust removal and improve the dust removal effect.

18 Claims, 4 Drawing Sheets

(56) References Cited

U.S. PATENT DOCUMENTS

| | | | | |
|---|---|---|---|---|
| 2003/0145418 | A1* | 8/2003 | Ikeda | B08B 1/04 15/345 |
| 2007/0044823 | A1 | 3/2007 | Yamamoto et al. | |
| 2011/0146065 | A1 | 6/2011 | Nagata et al. | |
| 2013/0047369 | A1* | 2/2013 | Heo | B08B 5/02 15/405 |
| 2013/0174873 | A1* | 7/2013 | Yoshihara | H05K 3/26 134/19 |
| 2014/0130981 | A1 | 5/2014 | Benson | |
| 2015/0255316 | A1 | 9/2015 | Dobashi et al. | |

FOREIGN PATENT DOCUMENTS

| | | | |
|---|---|---|---|
| CN | 102427047 | A | 4/2012 |
| CN | 203380147 | U | 1/2014 |
| CN | 204116669 | U | 1/2015 |
| CN | 104941972 | | 9/2015 |
| CN | 105149308A | A | 12/2015 |
| CN | 106040668 | A | 10/2016 |
| CN | 205667968 | U | 11/2016 |
| JP | 2008272704 | A | 11/2008 |

OTHER PUBLICATIONS

Office Action for U.S. Appl. No. 201610373425.6, dated Nov. 24, 2017, 16 pages.

ISR for Application Serial No. PCT/CN2017/082215, dated Jul. 28, 2017, 15 pages.

* cited by examiner

DUST REMOVAL DEVICE FOR A DISPLAY SCREEN, DUST REMOVAL METHOD AND CORRESPONDING DISPLAY DEVICE

CROSS-REFERENCE TO RELATED APPLICATIONS

This application is a National Phase Entry of PCT International Application No. PCT/CN2017/082215, which was filed on Apr. 27, 2017, and claims priority to Chinese Patent Application No. 201610373425.6, which was filed on May 27, 2016, the content of which is incorporated by reference in the entirety.

FIELD

The exemplary embodiments of the present disclosure relate to the field of clean technologies, and particularly to a dust removal device for a display screen, a dust removal method and corresponding display device.

BACKGROUND

In the long-term use of a display, dust in the air will be massively accumulated on the surface of the display. Therefore, after a period of time, the brand-new outer surface of the display will become dirty. Ordinarily, the dust on the surface of the display cannot be effectively removed by simple cleaning manners, such as a cleaning manner combining a cleaning cloth with clean water.

SUMMARY

In view of this, the exemplary embodiments of the present disclosure provide a dust removal device for a display screen, a dust removal method and corresponding display device, which can realize fixed-point mechanical dust removal and improve the dust removal effect.

An aspect of the present disclosure provides a dust removal device for a display screen, the dust removal device including:

at least one nozzle configured to eject gas to the display screen;

at least one mobile device configured to move the at least one nozzle to a predetermined position;

a gas supply device connected with the at least one nozzle via a conduit; and a control device configured to control the movement of the at least one mobile device and the gas ejection of the at least one nozzle.

According to an exemplary embodiment of the present disclosure, the dust removal device further includes: a detection device configured to detect the dust distribution on the display screen, wherein the control device controls the gas ejection of the at least one nozzle according to the dust distribution detected by the detection device.

According to an exemplary embodiment of the present disclosure, the dust removal device further includes: at least one speed control device configured to change the gas ejection speed of the at least one nozzle under the control of the control device.

According to an exemplary embodiment of the present disclosure, the dust removal device further includes at least one direction adjustment device configured to adjust the direction of the at least one nozzle.

According to an exemplary embodiment of the present disclosure, the at least one direction adjustment device is further configured to make the at least one nozzle swing.

According to an exemplary embodiment of the present disclosure, the control device is further configured to control the gas ejection time of the at least one nozzle.

According to an exemplary embodiment of the present disclosure, the dust removal device further includes a timing device, wherein when the timing device expires, the at least one mobile device moves the at least one nozzle to the predetermined position, and the control device controls the gas supply device to supply gas.

According to an exemplary embodiment of the present disclosure, the at least one direction adjustment device is further configured to adjust the direction of the at least one nozzle to be aligned with a dust point detected by the detection device.

According to an exemplary embodiment of the present disclosure, the at least one direction adjustment device is further configured to control the direction of the at least one nozzle to swing in the surrounding area of the detected dust point when the dust density in the surrounding area of the dust point detected by the detection device is larger than a first threshold.

According to an exemplary embodiment of the present disclosure, the control device is further configured to control the speed control device so as to increase the flow velocity of the gas flowing through the conduit when the distance between the dust point detected by the detection device and the predetermined position is larger than a second threshold, or when the dust density in the surrounding area of the dust point detected by the detection device is larger than a third threshold.

According to an exemplary embodiment of the present disclosure, the control device is further configured to prolong the gas ejection time of the at least one nozzle when the distance between the dust point detected by the detection device and the predetermined position is larger than a second threshold, or when the dust density in the surrounding area of the dust point detected by the detection device is larger than a third threshold.

According to an exemplary embodiment of the present disclosure, the gas supply device includes a positive and negative charge generation device, and supplies a gas flow including positive and negative charges to the at least one nozzle via the positive and negative charge generation device so as to remove static electricity.

According to an exemplary embodiment of the present disclosure, the detection device is further configured to detect again the dust distribution on the display screen after the at least one nozzle stops ejecting gas; if the detected dust distribution does not satisfy the preset dust standard, the control device controls the at least one mobile device not to move and controls the gas ejection of the at least one nozzle; if the detected dust distribution satisfies the preset dust standard, then the control device controls the at least one mobile device to move to an initial position and stops the gas ejection of the at least one nozzle.

According to an exemplary embodiment of the present disclosure, one end of the mobile device is provided with at least one nozzle while the other end has a fixed position, and the mobile device can rotate relative to its other end.

According to an exemplary embodiment of the present disclosure, the mobile device is a mechanical arm which includes a front mechanical arm, a rear mechanical arm and a connecting mechanism, wherein one end of the front mechanical arm is connected with one end of the rear mechanical arm via the connecting mechanism, the position of the other end of the rear mechanical arm is fixed, the rear mechanical arm can rotate relative to the other end of the rear mechanical arm, the connecting mechanism can adjust the included angle between the front mechanical arm and the rear mechanical arm, and the front mechanical arm is provided with at least one nozzle.

Another aspect of the present disclosure provides a display device including any of the above dust removal device and a display, wherein the dust removal device is arranged on the back face or the side face of the display.

Other aspects of the present disclosure provide a dust removal method of any of the above dust removal device, the dust removal method including:

periodically starting the dust removal device;

moving, by the at least one mobile device, the at least one nozzle to the predetermined position;

controlling, by the control device, the gas ejection of the at least one nozzle; and moving, by the at least one mobile device, the at least one nozzle to the initial position.

According to an exemplary embodiment of the present disclosure, controlling, by the control device, the gas ejection of the at least one nozzle includes: detecting the dust distribution on the display screen, and controlling, by the control device, the gas ejection of the at least one nozzle based on the detected dust distribution.

According to an exemplary embodiment of the present disclosure, controlling, by the control device, the gas ejection of the at least one nozzle based on the detected dust distribution includes: controlling, by the control device, the gas ejection speed and/or gas ejection time of the at least one nozzle based on the detected dust distribution.

According to an exemplary embodiment of the present disclosure, controlling, by the control device, the gas ejection of the at least one nozzle based on the detected dust distribution includes: setting, by the control device, a dust removal mode for the dust removal device, and the dust removal mode includes a fixed-point dust removal mode and a swing dust removal mode.

According to an exemplary embodiment of the present disclosure, controlling, by the control device, the gas ejection of the at least one nozzle based on the detected dust distribution includes: detecting the dust distribution on the display screen again after the at least one nozzle stops ejecting gas; if the detected dust distribution does not satisfy the preset dust standard, controlling, by the control device, the at least one mobile device not to move and controlling the gas ejection of the at least one nozzle; if the detected dust distribution satisfies the preset dust standard, stopping, by the control device, the gas ejection of the at least one nozzle.

BRIEF DESCRIPTION OF THE DRAWINGS

In order to describe the technical solutions of the embodiments of the present disclosure more clearly, a brief description will be made below on the accompanying drawings of the embodiments. Apparently, the accompanying drawings described below are merely related to some embodiments of the present disclosure, rather than limiting the present disclosure.

DETAILED DESCRIPTION OF THE EMBODIMENTS

In order to make the objectives, the technical solutions and the advantages of the present disclosure more apparent, a clear and complete description will be given below on the technical solutions of the embodiments in the present disclosure in combination with the drawings in the embodiments of the present disclosure. Apparently, the described embodiments are only a part but not all of the embodiments of the disclosure. Based on the embodiments of the disclosure herein, all of the other embodiments derived by those of ordinary skill in the art without any inventive effort shall all fall within the protection scope of the present disclosure.

In the description of the present disclosure, it should be noted that the directional or positional relationship indicated by terms such as "upper", "lower", "top" and "bottom" is the directional or positional relationship shown based on the drawings, which is merely for convenient and simplified description of the present disclosure, rather than indicating or implying that the referred device or element must have the specific direction or must be constructed and operated in the specific direction, therefore, it cannot be understood as a limitation to the present disclosure.

In addition, in the description of the present disclosure, unless otherwise specified, the meaning of "plurality" is two or more.

Figure 1:
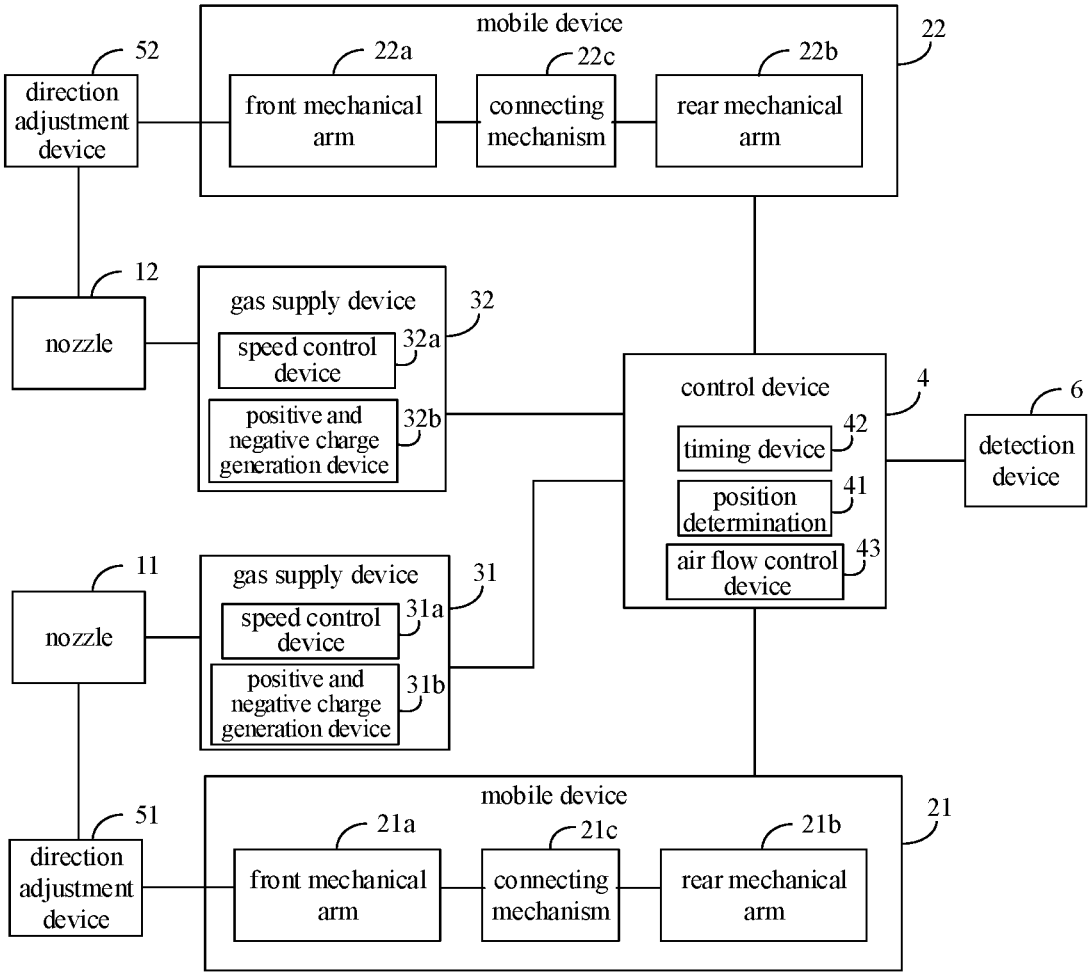
FIG. 1 is a schematic structural diagram of a dust removal device in an embodiment of the present disclosure.

FIG. 1 is a structural schematic diagram of a dust removal device in an exemplary embodiment of the present disclosure.

As shown in FIG. 1, the dust removal device 10 according to the exemplary embodiment of the present disclosure can be used for a display screen 20 and includes two nozzles 11 and 12, two mobile devices 21 and 22, two gas supply devices 31 and 32, and a control device 4. Specifically, the nozzles 11 and 12 are respectively connected with the gas supply devices 31 and 32 in an air-tight manner via conduits arranged at the end of the nozzles; the mobile devices 21 and 22 are physically connected with the two nozzles 11 and 12 and are configured to move the nozzles 11 and 12 to a predetermined position; the control device 4 is electrically connected with the gas supply devices 31 and 32, and is configured to control the opening or closing of the gas supply devices 31 and 32, so as to control the gas ejection of the two nozzles 11 and 12.

Therefore, the dust removal device 10 according to an exemplary embodiment of the present disclosure can move the nozzles 11 and 12 to a predetermined position via at least one of the mobile devices 21 and 22, so as to realize fixed-point mechanical dust removal and improve the dust removal effect.

Specifically, one end of the mobile device 21 or 22 is provided with a nozzle 11 or 12, the position of the other end of the mobile device 21 or 22 is fixed, and the mobile device 21 or 22 can rotate relative to its other end, so as to move the nozzle 11 or 12 to a predetermined position. For example, regarding to FIG. 2, the other end of the mobile device 21 or 22 can be fixed on a side face of a surface (the display area of the display screen 20) which is to be subject to dust removal, but not limited to the inside or outside, or can be fixed on other objects except the surface which is to be subject to dust removal. Through rotating the mobile device 21 or 22, the nozzle 11 or 12 can be moved to a predetermined position from its initial position, wherein the initial position of the nozzle 11 or 12 is the position in which the nozzle 11 or 12 is located when the dust removal device is closed, and the initial position can be the back face or side face of the display screen 20. The predetermined position of the nozzle 11 or 12 is the position to which the nozzle 11 or 12 moves when the dust removal device is opened. The predetermined position of the nozzle 11 or 12 will be described in detail below and will not be repeated redundantly herein.

Specifically, the mobile device 21 or 22 can be a mechanical arm. The mechanical arm can include a front mechanical arm (21*a* or 22*a*), a rear mechanical arm (21*b* or 22*b*) and a connecting mechanism (21*c* or 22*c*); one end of the front mechanical arm (21*a* or 22*a*) is connected with one end of the rear mechanical arm (21*b* or 22*b*) via the connecting mechanism (21*c* or 22*c*), the other end of the rear mechanical arm (21*b* or 22*b*) has a fixed position, and the rear mechanical arm (21*b* or 22*b*) can make conical movement relative to the other end of the rear mechanical arm (21*b* or 22*b*); the connecting mechanism (21*c* or 22*c*) can adjust the included angle between the front mechanical arm (21*a* or 22*a*) and the rear mechanical arm (21*b* or 22*b*), the front mechanical arm (21*a* or 22*a*) is provided with a nozzle 11 or 12, and through the movement of the front mechanical arm (21*a* or 22*a*) and the rear mechanical arm (21*b* or 22*b*), the nozzle 11 or 12 can move to its predetermined position. It should be noted that when the rear mechanical arm (21*b* or 22*b*) makes conical movement relative to the other end of the rear mechanical arm (21*b* or 22*b*), the included angle between the rear mechanical arm (21*b* or 22*b*) and the axis of the circular cone is in a range of 0-90 degrees; the included angle between the front mechanical arm (21*a* or 22*a*) and the rear mechanical arm (21*b* or 22*b*) is in a range of 0-180 degrees; and the connecting mechanism (21*c* or 22*c*) can be a pin roll or a hinge, namely, one end of the front mechanical arm (21*a* or 22*a*) can be connected with one end of the rear mechanical arm (21*b* or 22*b*) via the pin roll or the hinge. For example, the other end of the rear mechanical arm (21*b* or 22*b*) can be fixed on the back face or the side face of the surface which is to be subject to dust removal, or can be fixed to other objects except the surface which is to be subject to dust removal. Through rotating the rear mechanical arm (21*b* or 22*b*) and adjusting the included angle between the front mechanical arm (21*a* or 22*a*) and the rear mechanical arm (21*b* or 22*b*), the nozzle 11 or 12 can be moved to the predetermined position from its initial position.

It should be noted that the embodiment given in FIG. 1 is merely illustrative, while in other embodiments, the number of the nozzles and the mobile devices is not limited to two. In addition, one mobile device can not only move one nozzle to a designated position, but also can move a plurality of nozzles to designated positions. For example, the dust removal device 10 can include four nozzles and two mobile devices, and each mobile device can move two nozzles to their designated positions. The dust removal device according to an exemplary embodiment of the present disclosure is not only applicable to a display screen, but also applicable to other devices which need dust removal at regular intervals.

In order to realize precise control of the flow velocity of the gas of each nozzle, according to an exemplary embodiment of the present disclosure, speed control devices 31*a* and 32*a* can be respectively arranged on the conduit at the end of the nozzles 11 and 12, for example, regarding to FIG. 1, the speed control devices 31*a* and 32*a* can be respectively arranged in the gas supply devices 31 and 32, and the control device 4 can control the speed control devices 31*a* and 32*a* respectively.

Specifically, the speed control devices 31*a* and 32*a* can be a flow velocity control valve. The control device 4 can control the size of the opening of the flow velocity control valve via the setting of air flow control device 43, so as to adjust the flow velocity of the gas flow flowing through the conduit. According to an exemplary embodiment of the present disclosure, through the precise control of the flow velocity of the gas flow of each nozzle, the dust removal effect can be further improved.

The dust removal device 10 can further include two direction adjustment devices 51 and 52, each direction adjustment device can be arranged between each nozzle and a mobile device connected to the nozzle. When the mobile devices 21 and 22 move the nozzles 11 and 12 to a designated position, the position determination device 41 in the control device 4 can control the two direction adjustment devices to respectively adjust the directions of the nozzle 11 and the nozzle 12, so as to enable the nozzle 11 and the nozzle 12 to be aligned with corresponding positions. According to an exemplary embodiment of the present disclosure, through the adjustment of the direction of each nozzle, precise dust removal can be realized.

Furthermore, the dust removal device 10 can further include two swing devices. After the two direction adjustment devices adjust the directions of the nozzle 11 and the nozzle 12 to be aligned with the corresponding positions, two swing devices can respectively control the directions of the nozzle 11 and the nozzle 12 to swing in their corresponding areas. For example, each swing device can control the nozzle to swing from the left to the right and/or swing up and down at an angle of less than 90 degrees. According to other embodiments of the present disclosure, each swing device can also control the nozzle to make conical movement at an angle of less than 90 degrees. According to an exemplary embodiment of the present disclosure, through controlling the nozzles 11 and 12 to swing in the area in which dust is concentrated, the dust in the area in which dust is concentrated can be removed, and the dust removal effect can be further improved.

It should be noted that the function realized via the swing device can be respectively incorporated into the direction adjustment devices 51 and 52, namely, the direction adjustment devices 51 and 52 can also control the swing of the nozzle 11 and the nozzle 12, respectively.

Furthermore, the control device 4 can also set the gas ejection time for the nozzles 11 and 12, while the nozzle 11 or the nozzle 12 stops gas ejection after the gas ejection time reaches the set gas ejection time. Therefore, according to an exemplary embodiment of the present disclosure, the energy consumption caused by continuous gas ejection of the nozzles 11 and 12 can be lowered.

In order to realize the periodical start of the dust removal device 10, the dust removal device 10 can further include a timing device 42. When the timing device 42 expires, the mobile devices 21 and 22 move the nozzles 11 and 12 to their predetermined positions, and the control device 4 opens the gas supply devices 31 and 32. It should be noted that the timing device can be set in advance according to surrounding environment and/or personal preference, for example, in the environment with more dust, the dust removal device 10 can be set to start at 6:00 a.m. and 6:00 p.m. every day; while in the environment with less dust, the dust removal device 10 can be set to start at 6:00 a.m. every day. According to an exemplary embodiment of the present disclosure, dust removal at regular intervals can be realized, and the surface which is to be subject to dust removal can keep clean continuously.

Furthermore, the dust removal device 10 can further include a detection device 6 which can detect the dust distribution on the surface which is to be subject to dust removal. The detection device can be a scanning device which can detect the surface to be subject to dust removal, such as a laser scanning device, and through scanning the surface which is to be subject to dust removal, the point position (namely, the dust point) in which the dust is concentrated and/or the area in which the dust is concentrated on the surface which is to be subject to dust removal can be detected.

Correspondingly, the direction adjustment devices 51 and 52 can respectively adjust the direction(s) of the nozzle 11 and/or the nozzle 12 to be aligned with the dust point detected by the detection device. When the dust density in the surrounding area of the dust point detected by the detection device is larger than a first threshold, the direction adjustment devices 51 and 52 controls the nozzle 11 and/or the nozzle 12 to swing in the surrounding area of the detected dust point, and the swing scope can be set in advance. Therefore, according to the exemplary embodiment of the present disclosure, precise dust removal can be realized.

It should be noted that the direction adjustment device can include a power device and a transmission device, wherein the power device can be a motor arranged on a mechanical arm, while the transmission device can be a gear transmission device or a worm transmission device. The motor is connected with one end of the nozzle(s) 11 and/or 12 via the gear transmission device or the worm transmission device, so as to adjust the direction(s) of the nozzle 11 and/or the nozzle 12. According to the exemplary embodiment of the present disclosure, the direction adjustment device can also receive control signals from the control device, so as to control the rotational speed and/or rotational time of the motor, and control the transmission direction of the gear transmission device or the worm transmission device.

Correspondingly, since the position determination device 41 is provided inside the control device 4 and the detection device 6 is connected to the control device 4, when the detection device 6 determines through the control device 4 that the distance between the dust point detected by the detection device and the predetermined position is larger than a second threshold, namely, when the distance between the dust point and the nozzle 11 or 12 is relatively far, the control device 4 may control the speed control devices 31*a* and 32*a*, so as to increase the flow velocity of the gas flowing through the conduit, or the control device 4 may prolong the gas ejection time of the nozzle 11 or 12. Therefore, according to the exemplary embodiment of the present disclosure, the dust removal effect can be further improved.

Correspondingly, when the dust density in the surrounding area of the dust point detected by the detection device 6 through the control device 4 is larger than a third threshold, the control device 4 may control the speed control devices 31*a* and 32*a*, so as to increase the flow velocity of the gas flowing through the conduit, or the control device 4 may prolong the gas ejection time of the nozzle 11 or 12. Therefore, according to the exemplary embodiment of the present disclosure, the dust removal effect can be further improved.

Furthermore, the gas supply devices 31 and 32 can respectively include a positive and negative charge generation devices 31*b* and 32*b*, and supplies a gas flow including positive and negative charges to the nozzles 11 and 12 via the positive and negative charge generation device, so as to remove static electricity.

Furthermore, the detection device can be further configured to detect again the dust distribution on the surface which is to be subject to dust removal after all the nozzles 11 and 12 stop gas ejection; when the dust distribution detected by the detection device 6 through the control device 4 does not satisfy a predetermined detection condition, namely, when the dust distribution detected by the detection device does not satisfy the predetermined dust standard, the mobile devices 21 and 22 make the nozzles 11 and 12 maintain at the predetermined positions, and the control device 4 starts the gas supply devices 31 and 32, so as to control the nozzles 11 and 12 to eject gas; when the detected dust distribution satisfies the predetermined detection condition, namely, when the dust distribution detected by the detection device satisfies the predetermined dust standard, the mobile devices 21 and 22 make the nozzles 11 and 12 return to their initial positions, and the control device 4 closes the gas supply devices 31 and 32, so as to stop the gas ejection of the nozzles 11 and 12. According to the exemplary embodiment of the present disclosure, the initial position of the nozzles 11 and 12 can be located at the back face or the side face of the surface which is to be subjected to dust removal, so as to avoid the influence on the normal use of the surface which is to be subject to dust removal.

Figure 2:
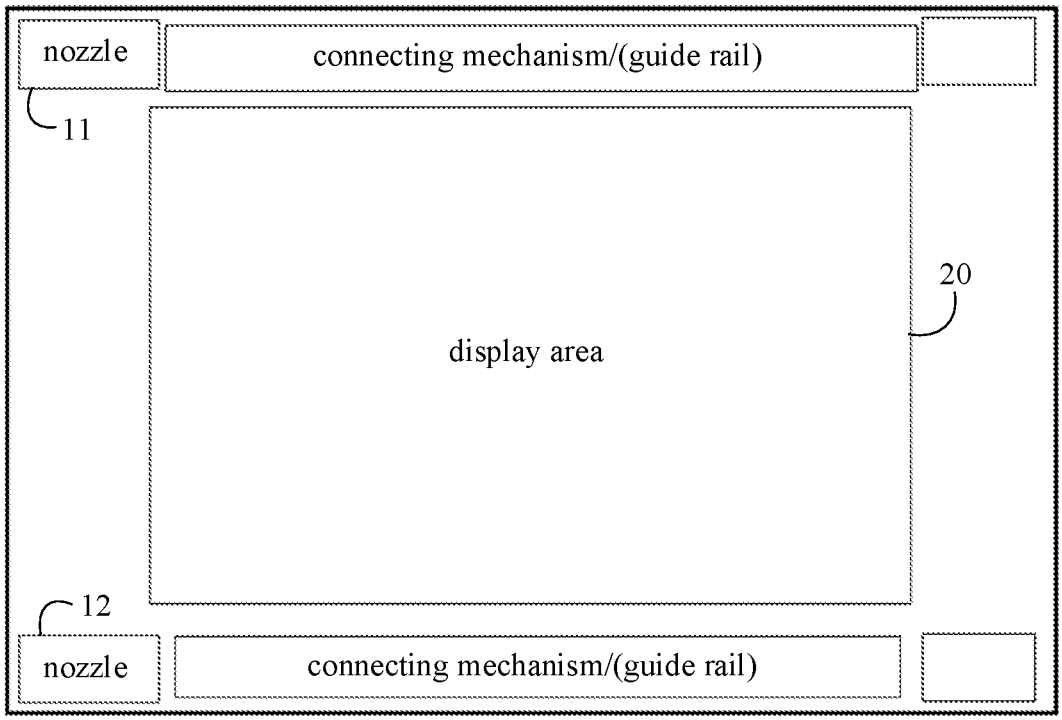
FIG. 2 is schematic diagram of a predetermined position of a nozzle in an embodiment of the present disclosure.

FIG. 2 shows the predetermined positions of the nozzles according to the embodiments of the present disclosure.

As shown in FIG. 2, the surface which is subject to dust removal is a rectangle, while the predetermined positions of the nozzles are above the four corners of the surface which is to be subjected to dust removal. It is not difficult to understand by the skilled in the art that the predetermined positions of the nozzles as shown in FIG. 2 are only illustrative. According to another exemplary embodiment of the present disclosure, the nozzles can have only one predetermined position, and can be located in the central position of the surface which is to be subject to dust removal. According to other exemplary embodiments of the present disclosure, the predetermined positions of the nozzles can also be in other numbers, and the nozzles can be evenly distributed above the surface which is to be subject to dust removal.

Figure 3:
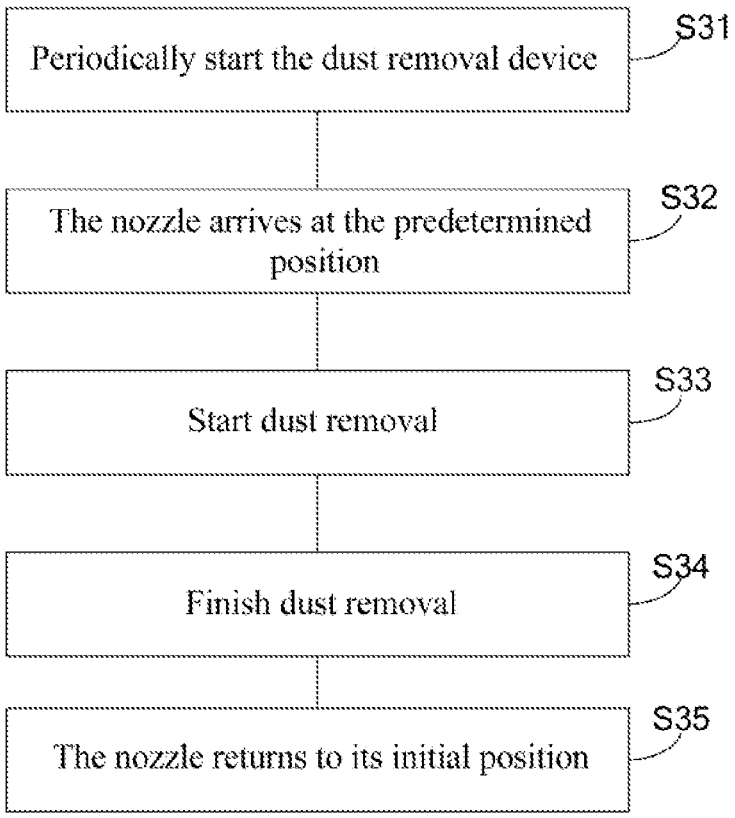
FIG. 3 is a flow chart of a dust removal method in an embodiment of the present disclosure.

FIG. 3 shows a flow chart of a dust removal method according to an embodiment of the present disclosure.

As shown in FIG. 3, in step S31, periodically start the dust removal device 10.

Specifically, when the timing device in the dust removal device 10 expires, the dust removal device 10 is started. It should be noted that the timing device can be set in advance according to surrounding environment and/or personal preference, for example, in the environment with more dust, the dust removal device 10 can be set to start at 6:00 a.m. and 6:00 p.m. every day, while in the environment with less dust, the dust removal device 10 can be set to start at 6:00 a.m. every day.

In step S32, the mobile devices 21 and 22 move the nozzles 11 and 12 to a predetermined position. The relationship between the mobile devices 21 and 22 and the nozzles 11 and 12 as well as the setting of the predetermined position have already been described above, and will not be repeated redundantly herein.

In step S33, the control device 4 opens the gas supply devices 31 and 32 to start dust removal.

In step S34, the control device 4 can respectively set the gas ejection time for the nozzles 11 and 12, while the nozzles 11 and 12 stop gas ejection after the gas ejection time reaches the set gas ejection time. When all the nozzles 11 and 12 stop gas ejection, the control device 4 can close the gas supply devices 31 and 32 to finish dust removal.

In step S35, the mobile devices 21 and 22 make the nozzles 11 and 12 return to their initial positions, so as to avoid the influence on the normal use of the surface which is to be subject to dust removal, wherein the initial position can be located at the back face or the side face of the surface which is to be subjected to dust removal.

Figure 4:
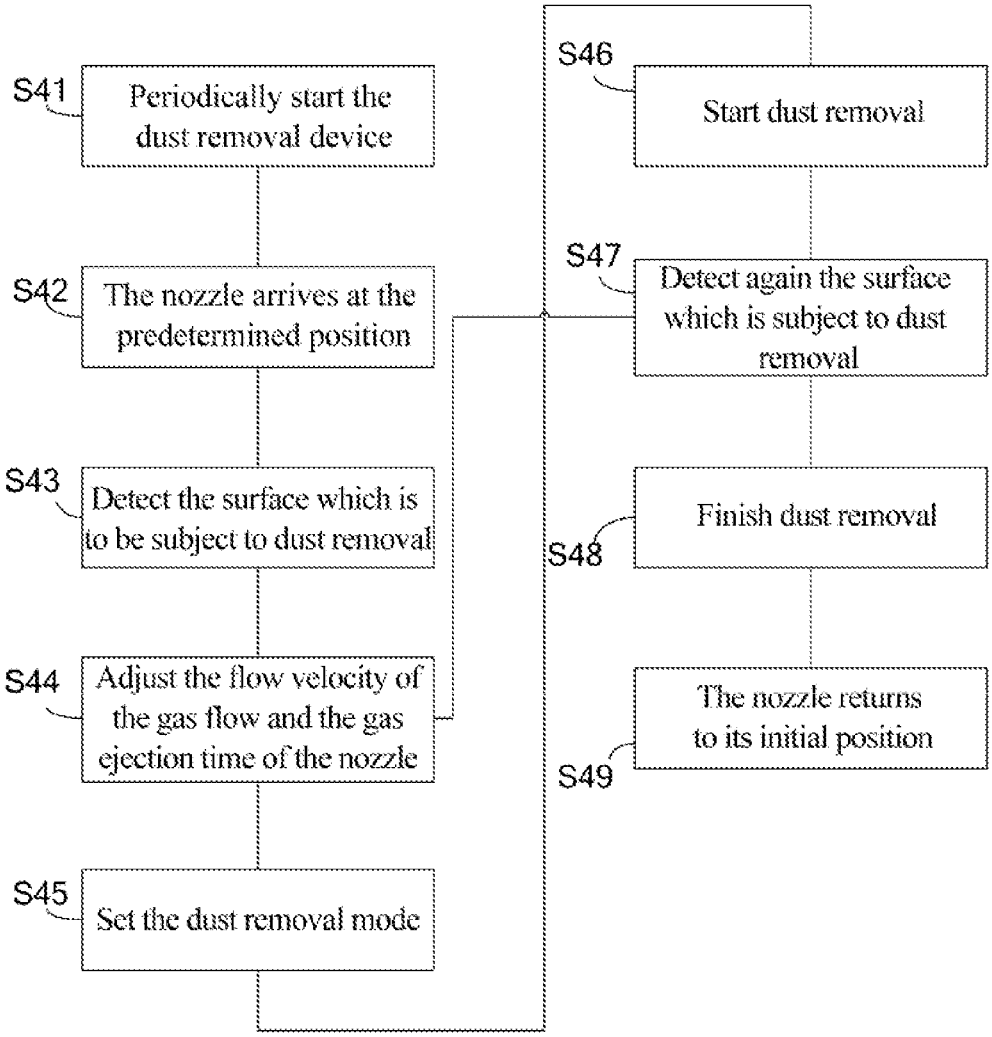
FIG. 4 is a flow chart of a dust removal method in another embodiment of the present disclosure.

FIG. 4 shows a flow chart of a dust removal method according to another embodiment of the present disclosure.

As shown in FIG. 4, in step S41, periodically start the dust removal device 10.

Specifically, when the timing device 42 in the dust removal device 10 expires, the dust removal device 10 is started. It should be noted that the timing device can be set in advance according to surrounding environment and/or personal preference, for example, in the environment with more dust, the dust removal device 10 can be set to start at 6:00 a.m. and 6:00 p.m. every day, while in the environment with less dust, the dust removal device 10 can be set to start at 6:00 a.m. every day.

In step S42, the mobile devices 21 and 22 move the nozzles 11 and 12 to a predetermined position. The relationship between the mobile devices 21 and 22 and the nozzles 11 and 12 as well as the setting of the predetermined position have been described above, and will not be repeated redundantly herein.

In step S43, the detection device in the dust removal device 10 can detect the dust distribution on the surface which is to be subject to dust removal, such as detecting the dust point and/or the area in which dust is concentrated on the surface which is to be subject to dust removal.

In step S44, the control device 4 controls the speed control devices 31*a* and 32*a* respectively, based on the detected dust distribution and sets the gas ejection time of the nozzles 11 and 12.

For example, when the distance between the dust point detected by the detection device and the predetermined position is larger than a second threshold, namely, when the distance between the dust point and the nozzle 11 or 12 is relatively far, the control device 4 may control the speed control devices 31*a* and 32*a* respectively, so as to increase the flow velocity of the gas flowing through the conduit, or the control device 4 may prolong the gas ejection time of the nozzle 11 or 12. Or, when the dust density in the surrounding area of the dust point detected by the detection device is larger than a third threshold, the control device 4 may control the speed control devices 31*a* and 32*a* respectively, so as to increase the flow velocity of the gas flowing through the conduit, or the control device 4 may prolong the gas ejection time of the nozzle 11 or 12.

In step S45, the control device 4 can set a dust removal mode for the dust removal device 10 based on the detected dust distribution. The dust removal mode includes a fixed-point dust removal mode and a swing dust removal mode, wherein the fixed-point dust removal mode means that a directional adjustment device adjusts the direction(s) of the nozzle 11 and/or the nozzle 12 to be aligned with the dust point detected by the detection device, and the swing dust removal mode means that the swing device or the direction adjustment device controls the nozzle 11 and/or the nozzle 12 to swing in the surrounding area of the detected dust point.

For example, when the detection device detects the dust point, and the dust density in the surrounding area of the dust point is smaller than a first threshold, then the control device 4 sets a fixed-point dust removal mode; and when the detection device detects a dust point and the dust density in the surrounding area of the dust point is larger than a first threshold, then the control device 4 sets a swing dust removal mode.

In step S46, the control device 4 starts the gas supply devices 31 and 32 to start dust removal.

In step S47, after all the nozzles stop gas ejection, the detection device again detects the surface which is to be subject to dust removal. When the dust distribution detected by the detection device does not satisfy the predetermined detection condition, namely, when the dust distribution detected by the detection device does not satisfy the predetermined dust standard, the flow returns to step S44. When the detected dust distribution satisfies the predetermined detection condition, namely, when the dust distribution detected by the detection device satisfies the predetermined dust standard, execute step S48, namely, the control device 4 closes the gas supply devices 31 and 32 to finish dust removal.

In step S49, the mobile devices 21 and 22 make the nozzles 11 and 12 return to their initial positions, wherein the initial position can be located at the back face or side face of the surface which is to be subject to dust removal.

Based on the same conception, the embodiments of the present disclosure further provide a display device which includes any of the above dust removal device 10 and a display, wherein the display 10 is arranged on the back face or side face of the display. The display device based on the exemplary embodiments of the present disclosure can realize fixed-point mechanical dust removal and improve the dust removal effect.

It should be noted that the display device in the present embodiment can be a display panel, an electronic paper, a mobile phone, a tablet computer, a television, a notebook computer, a digital photo frame, a navigator and any other product or part with a display function.

The above described are merely specific embodiments of the present disclosure, however, the protection scope of the present disclosure is not limited thereto. The variations or substitutions easily conceived by those skilled in the art within the technical scope disclosed by the present disclosure shall all fall within the protection scope of the present disclosure. Therefore, as to the protection scope of the present disclosure, the protection scope of the claims shall prevail.

The invention claimed is:

1. A dust removal device for a display screen, comprising:

at least one nozzle configured to eject gas to the display screen;

at least one mobile device configured to move the at least one nozzle to a predetermined position;

a gas supply device connected with the at least one nozzle via a conduit; and a control device configured to control the movement of the at least one mobile device and the gas ejection of the at least one nozzle;

wherein the dust removal device for the display screen further comprises a detection device configured to detect dust distribution on the display screen, wherein the control device controls the gas ejection of the at least one nozzle according to the dust distribution detected by the detection device.

2. The dust removal device according to claim 1, further comprising at least one speed control device configured to change the gas ejection speed of the at least one nozzle under the control of the control device.

3. The dust removal device according to claim 2, wherein the control device is further configured to control the speed control device so as to increase the flow velocity of the gas flowing through the conduit when the distance between the dust point detected by the detection device and the predetermined position is larger than a second threshold, or when the dust density in the surrounding area of the dust point detected by the detection device is larger than a third threshold.

4. The dust removal device according to claim 1, further comprising at least one direction adjustment device configured to adjust the direction of the at least one nozzle;

optionally the at least one direction adjustment device is further configured to make the at least one nozzle swing.

5. The dust removal device according to claim 4, wherein the at least one direction adjustment device is further configured to adjust the direction of the at least one nozzle to be aligned with a dust point detected by the detection device.

6. The dust removal device according to claim 5, wherein the at least one direction adjustment device is further configured to control the direction of the at least one nozzle to swing in the surrounding area of the detected dust point when the dust density in the surrounding area of the dust point detected by the detection device is larger than a first threshold.

7. The dust removal device according to claim 1, wherein the control device is further configured to control the gas ejection time of the at least one nozzle.

8. The dust removal device according to claim 7, wherein the control device is further configured to prolong the gas ejection time of the at least one nozzle when the distance between the dust point detected by the detection device and the predetermined position is larger than a second threshold, or when the dust density in the surrounding area of the dust point detected by the detection device is larger than a third threshold.

9. The dust removal device according to claim 1, further comprising a timing device, wherein when the timing device expires, the at least one mobile device moves the at least one nozzle to the predetermined position, and the control device controls the gas supply device to supply gas.

10. The dust removal device according to claim 1, wherein the gas supply device includes a positive and negative charge generation device, and supplies a gas flow including positive and negative charges to the at least one nozzle via the positive and negative charge generation device so as to remove static electricity.

11. The dust removal device according to claim 1, wherein the detection device is further configured to detect again the dust distribution on the display screen after the at least one nozzle stops ejecting gas; if the detected dust distribution does not satisfy the preset dust standard, the control device controls the at least one mobile device not to move and controls the gas ejection of the at least one nozzle; if the detected dust distribution satisfies the preset dust standard, then the control device controls the at least one mobile device to move to an initial position and stops the gas ejection of the at least one nozzle.

12. The dust removal device according to claim 1, wherein one end of the mobile device is provided with at least one nozzle while the other end has a fixed position, and the mobile device can rotate relative to its other end.

13. The dust removal device according to claim 1, wherein the mobile device is a mechanical arm which includes a front mechanical arm, a rear mechanical arm and a connecting mechanism, wherein one end of the front mechanical arm is connected with one end of the rear mechanical arm via the connecting mechanism, the position of the other end of the rear mechanical arm is fixed, the rear mechanical arm can rotate relative to the other end of the rear mechanical arm, the connecting mechanism can adjust the included angle between the front mechanical arm and the rear mechanical arm, and the front mechanical arm is provided with at least one nozzle.

14. A display device, comprising a dust removal device for a display screen and a display, wherein the dust removal device is arranged on the back face or the side face of the display, the dust removal device comprises:

at least one nozzle configured to eject gas to the display screen;

at least one mobile device configured to move the at least one nozzle to a predetermined position;

a gas supply device connected with the at least one nozzle via a conduit; and a control device configured to control the movement of the at least one mobile device and the gas ejection of the at least one nozzle;

a detection device configured to detect dust distribution on the display screen, wherein the control device controls the gas ejection of the at least one nozzle according to the dust distribution detected by the detection device.

15. A dust removal method of a dust removal device for a display screen, wherein the dust removal device comprises:

at least one nozzle configured to eject gas to the display screen;

at least one mobile device configured to move the at least one nozzle to a predetermined position;

a gas supply device connected with the at least one nozzle via a conduit; and a control device configured to control the movement of the at least one mobile device and the gas ejection of the at least one nozzle;

wherein the method comprises:

periodically starting the dust removal device;

moving, by the at least one mobile device, the at least one nozzle to the predetermined position;

controlling, by the control device, the gas ejection of the at least one nozzle; and moving, by the at least one mobile device, the at least one nozzle to the initial position;

wherein controlling, by the control device, the gas ejection of the at least one nozzle comprises: detecting the dust distribution on the display screen, and controlling, by the control device, the gas ejection of the at least one nozzle based on the detected dust distribution.

16. The dust removal method according to claim 15, wherein controlling, by the control device, the gas ejection of the at least one nozzle based on the detected dust distribution comprises: controlling, by the control device, the gas ejection speed and/or gas ejection time of the at least one nozzle based on the detected dust distribution.

17. The dust removal method according to claim 15, wherein controlling, by the control device, the gas ejection of the at least one nozzle based on the detected dust distribution comprises: setting, by the control device, a dust removal mode for the dust removal device, wherein the dust removal mode comprises a fixed-point dust removal mode and a swing dust removal mode.

18. The dust removal method according to claim 15, wherein controlling, by the control device, the gas ejection of the at least one nozzle based on the detected dust distribution comprises: detecting the dust distribution on the display screen again after the at least one nozzle stops ejecting gas; if the detected dust distribution does not satisfy the preset dust standard, controlling, by the control device, the at least one mobile device not to move and controlling the gas ejection of the at least one nozzle; if the detected dust distribution satisfies the preset dust standard, stopping, by the control device, the gas ejection of the at least one nozzle.

* * * * *